United States Patent [19]

Knetzer

[11] Patent Number: 5,052,066

[45] Date of Patent: Oct. 1, 1991

[54] WATERBED SHEETING SYSTEM WITH CLAMPING DEVICE

[76] Inventor: Marvin Knetzer, 1232 Baker, Wichita, Kans. 67212

[21] Appl. No.: 649,955

[22] Filed: Feb. 4, 1991

[51] Int. Cl.[5] ..... A47C 27/10

[52] U.S. Cl. ..... 5/451; 5/508; 24/72.5

[58] Field of Search ..... 5/451, 450, 452, 496, 5/498, 508, 400; 24/72.5

[56] References Cited

U.S. PATENT DOCUMENTS

| | | | |
|---|---|---|---|
| 672,881 | 4/1901 | Allen | 5/498 |
| 807,706 | 12/1905 | Allen | 24/72.5 |
| 1,606,367 | 4/1926 | Holt | 24/72.5 |
| 2,653,363 | 9/1953 | Lievsay, Jr. | 24/72.5 |
| 4,228,555 | 10/1980 | Katzakian | 5/451 |
| 4,624,022 | 11/1986 | Dolan | 5/508 |

*Primary Examiner*—Alexander Grosz

*Attorney, Agent, or Firm*—Litman, McMahon & Brown

[57] ABSTRACT

A waterbed sheeting system includes a clamping device with a pressure panel movable between open and closed positions for respectively releasing and gripping sheets on a waterbed. An actuator assembly includes a lever subassembly with a lower handle end and an upper cam end. The upper cam end engages the pressure panel in its open position. The lever subassembly is mounted on a frame of the waterbed and is rotatably for actuating the pressure panel between its open and closed position.

20 Claims, 1 Drawing Sheet

WATERBED SHEETING SYSTEM WITH CLAMPING DEVICE

BACKGROUND OF THE INVENTION

1. Field of the Invention

The present invention relates generally to sheeting systems, and in particular to a waterbed sheeting system with a clamping device.

2. Description of the Related Art

Various clamps and related mechanisms have heretofore been proposed for clamping and securing various objects. Such devices can be designed to meet the requirements of their particular applications, taking into account the characteristics of the objects to be clamped, the magnitudes of the required clamping forces, and other factors. The arrangements for setting and releasing the clamping devices are also commonly addressed in their designs.

Bed sheets for typical mattresses are commonly secured by either folding them under the mattresses or by providing elastic-fitted corners for receiving the mattress corners. Waterbeds, however, can present special sheeting problems. For example, one type of waterbed includes a generally rectangular, box-like water mattress formed of flexible plastic for placement within a rigid, rectangular frame. The weight of the water and the outward pressure of the water mattress against the frame can contribute to difficulties encountered in waterbed sheeting procedures.

One solution to these problems is to enclose the water mattress in a semi-rigid frame having the general configuration of a conventional mattress to which conventional fitted sheets can be applied. Such self-contained water mattresses may contain less water and thus be lighter in weight than more conventional water mattresses, but they can involve a sacrifice of some of the traditional waterbed "feel", and can be more expensive than conventional waterbeds.

Heretofore there has not been available a waterbed sheeting system with the advantages and features of the present invention, which addresses some of the problems and considerations as noted above.

SUMMARY OF THE INVENTION

In the practice of the present invention, a waterbed sheeting system is provided which can be mounted on a waterbed including head, foot and opposite side rails forming a bed frame resting on top of a bed floor, which can be supported on a pedestal. The waterbed sheeting system includes a clamping device which includes a pressure panel assembly comprising a pressure panel swingably mounted on the bed floor by a hinge. The pressure panel is generally located between a bed frame rail and a wall of a water mattress. An actuator assembly includes a mounting bracket subassembly for mounting on the frame rail between the pressure panel and the rail inside face. An actuator lever subassembly includes an upper, actuator end and a lower, handle end interconnected by a shaft journaled in the mounting subassembly for rotation of the lever subassembly between a clamp position with said pressure panel clamping a sheet against said rail and a release position with said pressure panel spaced from said rail. The shaft extends through an opening in the bed floor and the lever handle end mounts a handle accessible from beneath the bed floor.

OBJECTS AND ADVANTAGES OF THE INVENTION

The objects and advantages of the present invention include: providing a waterbed sheeting system; providing such a sheeting system which includes clamping device; providing such a device which facilitates sheeting and unsheeting a waterbed; providing such a device which facilitates the use of flat sheets with waterbeds; providing such a device which is adaptable for use with waterbeds having frames and water mattresses; providing such a device which is adaptable for use with waterbeds having safety liners; providing such a device which can be attached to one or more of the frame rails of a waterbed; providing such a device which is substantially hidden from view when installed on a waterbed; providing such a device which is relatively easy to operate on a waterbed; providing such a device which is economical to manufacture, efficient in operation, capable of a long operating life and particularly well-adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
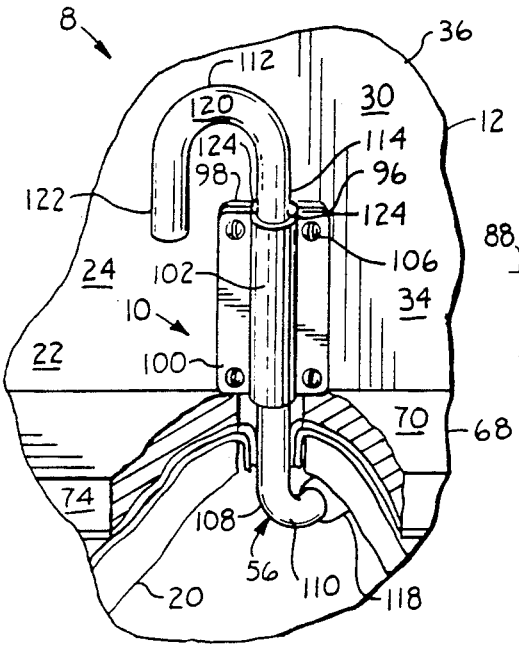
FIG. 1 is a fragmentary, top, inner perspective view of a waterbed sheeting system with a clamping device embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching on skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Without limitation on the generality of useful applications of the clamping device 10, an exemplary application shown and described herein is on a waterbed 12 for clamping a sheet or sheets 14 thereon. The waterbed 12 includes a platform 16 comprising a pedestal 18 for supporting the waterbed 12 on a floor and a bed floor 20 placed on top of the pedestal 18. The pedestal 18 can include built-in drawers (not shown) for storage under the bed floor 20.

A bed frame 22 includes a pair of side rails 24 with upper and lower edges 26, 28 and inner and outer faces 30, 32. The side rails 24 can be connected to head and foot rails or boards (not shown) to provide the bed frame 22 with a generally rectangular configuration. The rail lower edges 28 rest on the bed floor 20 whereby a relatively shallow, rectangular, upwardly-open mattress receptacle 34 is bounded by the rails and the bed floor 20.

The platform 16 and the rails are collectively referred to as a frame assembly 36. The waterbed 12 also includes a mattress liner 38 with a configuration generally conforming to that of the mattress receptacle 34 with a liner floor 40 positioned on top of the bed floor 20 and a liner wall 42 positioned against the rail inside faces 30. A water mattress 44 includes upper and lower panels 46, 48 and mattress walls 50. The water mattress 44 can be filled with water 52.

The waterbed 12 described thus far is of a type which is commonly available. However, the clamping device 10 could be applied to other structures, including other types of waterbeds.

The clamping device 10 generally comprises a panel assembly 54 and an actuator assembly 56.

II. Panel Assembly 56

The panel assembly 56 includes a pressure panel 58 with upper and lower edges 60, 62 and inner and outer faces 64, 66.

A hinge base member 68 includes upper and lower surfaces 70, 72 and inner and outer edges 74, 76, and is installed in the mattress receptacle 34 with the lower surface 72 on top of the bed floor 20 and the outer edge 76 against the rail inner face 30 adjacent to its lower edge 28. A generally vertical notch or base receiver 78 extends between and is open at the upper and lower surfaces 70, 72, and is outwardly-open at the hinge base member outer edge 76. The hinge base member 68 can be fastened to the bed floor 20 by suitable mechanical fasteners such as screws 79.

Figure 2:
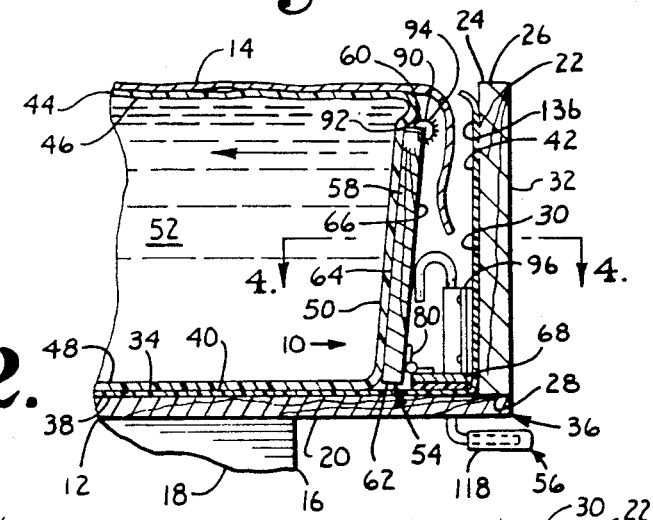
FIG. 2 is a vertical, cross-sectional view thereof, showing the clamping device in a release position.
Figure 3:
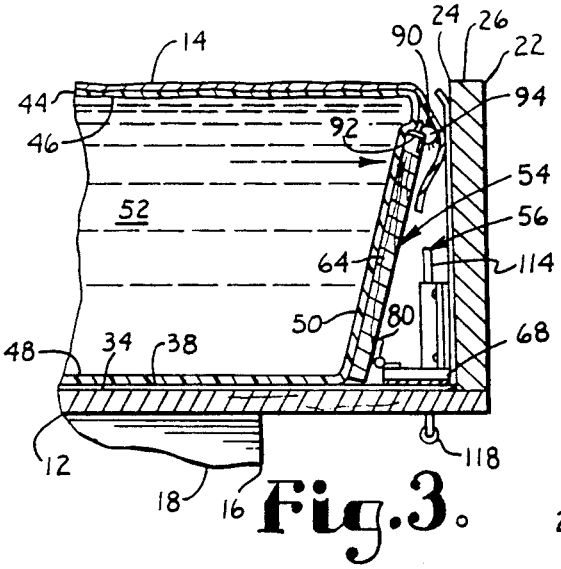
FIG. 3 is a vertical, cross-sectional view thereof, showing the clamping device in a clamped position.

A butt-type hinge 80 includes a base leaf 82 mounted on the base member upper surface 70 and a panel leaf 84 mounted on the panel inner face 64. The leaves 82, 84 are pivotally interconnected by a hinge pin 86 which is axially aligned on a pivotal axis 88 located just above an intersection of the hinge base member upper surface 70 and inner edge 74. The pressure panel 58 is thus pivotable about the pivotal axis 88 between a release or open position (FIG. 2) and a clamp or closed position (FIG. 3).

A sheet-gripping subassembly 90 includes a J-channel 92 mounted on the pressure panel upper edge 60 and a resilient, ribbed material strip 94 mounted on the J-channel 92 facing upwardly and outwardly therefrom for resilient, frictional clamping engagement with the sheet 14.

III. Actuator Assembly 56

The actuator assembly 56 includes a mounting bracket subassembly 96 comprising a bracket base plate 98 and a saddle clamp 100 with an arch 102 forming a bracket receiver 104 with the base plate 98. The mounting bracket subassembly 96 can be attached to the rail 24 by suitable mechanical fasteners, such as bracket-to-rail screws 106.

A lever subassembly 108 includes a lower, handle end 110 and an upper, cam end 112 interconnected by a generally vertical shaft 114 journaled in the base and mounting bracket receivers 78, 104. The lever handle end 110 can include a handle shaft 116 mounting a handle 118 and the upper, cam end 112 can include an arcuate extension leg 120 and a downwardly-extending return leg 122 whereby the upper, cam end 112 has an inverted U-shaped general configuration. A pair of ears 124 can be formed in the shaft 114 adjacent to the upper, cam end 112 for rotatably bearing upon the mounting bracket subassembly 96. The upper, cam end 112, the shaft 114 and the handle shaft 116 can be formed, e.g. bent, from a single piece of a suitable material, such as steel rod.

IV. Installation and Operation

For retrofitting on an existing waterbed 12, the water mattress 44 should preferably be drained. The clamping device 10 can also be installed on waterbeds when they are originally manufactured.

A waterbed can include multiple clamping devices 10 installed on side rails 24 and on head and foot rails or boards. The pressure panels 58 can be of sufficient width that one clamping device 10 per rail will normally suffice, or multiple clamping devices 10 can be installed on each rail. Installing a pair of clamping devices 10 on the side rails 24 can significantly expedite installation and removal of sheets 14 on the waterbed 12, and additional clamping devices 10 can be provided on the head and foot rails or boards to further expedite installation and removal of the sheets 14 thereat.

The panel assembly 54 can be generally centered on a respective side rail 24 and a hole 126 (for example with a $\frac{3}{8}$" diameter) can be drilled in the bed floor 20 for alignment with the base member notch or receiver 78. The lever subassembly 108 can be installed by inserting the handle shaft 116, without the handle 118, through the bed floor hole 126. The base member 68 can be fastened to the bed floor 20 with suitable mechanical fasteners, such as base-to-floor screws 128. When the base member 68 is installed, its notch or receiver 78 receives the shaft 114.

The mounting bracket subassembly 96 is installed by placing the shaft 114 in the bracket receiver 104 and fastening the mounting bracket subassembly 96 to the rail 24 with suitable mechanical fasteners, such as the bracket-to-rail screws 106. The bed floor hole 126, the base member receiver 78 and the bracket receiver 104 are all preferably vertically aligned on a rotational axis 132 of the shaft 114, which is journaled in the hole 126 and in the receivers 78, 104. The handle 118 can be installed on the handle shaft 116.

The lever subassembly 108 can be sealed to the mattress liner 38 with duct tape 134 or with any other suitable gasket and/or sealing means. The mounting screws 128, 130 normally will not significantly compromise the effectiveness of the mattress liner 38 where they penetrate it because such penetrations are generally covered by the base member 68 and the bracket base plate 98 respectively, but these penetrations could also be sealed by any suitable means.

Figure 4:
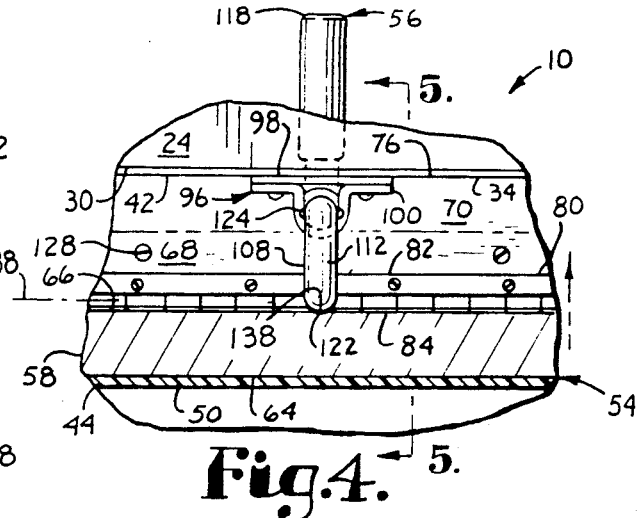
FIG. 4 is a top plan view thereof showing the clamping device in its release position and taken generally along line 4—4 in FIG. 2.

In operation, installing and removing the sheet 14 is facilitated. In a release position (FIG. 2), a clearance 136 is formed between the pressure panel upper edge 60 and the rail inner face 30. The clearance 136 can receive the sheet 14. The actuator assembly 56 can be maintained in a release or open position by frictional engagement between the pressure panel outer face 66 and the lever assembly upper cam end 112. Alternatively, the pressure panel outer face 66 could be provided with a detent or notch 138 for receiving the lever return leg 122 (FIG. 4).

Figure 5:
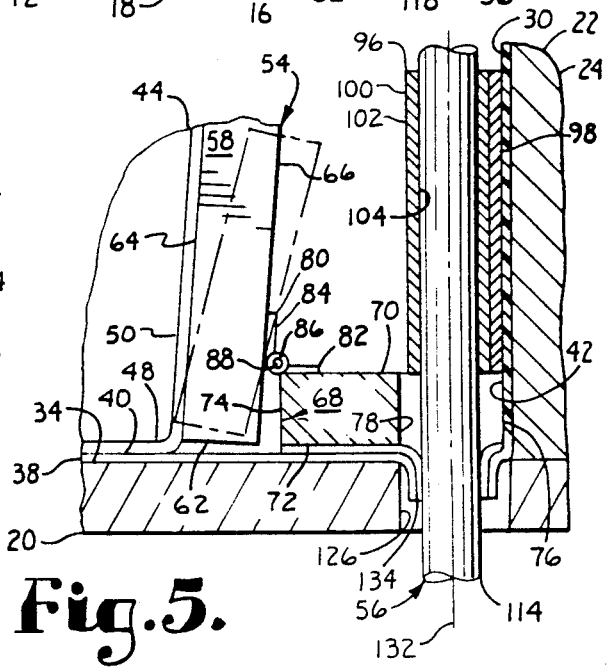
FIG. 5 is an enlarged, fragmentary, vertical cross-sectional view thereof taken generally along line 5—5 in FIG. 4.

Turning the lever subassembly 108 approximately 90 degrees in either direction from its open or release position by means of the handle 118 places the clamping device 10 in its closed or clamp position (FIG. 3) with the sheet 14 clamped between the sheet-gripping strip 94 and the rail inner face 30. The weight of the water 52 in the mattress 44, which exerts an outwardly-directed force due to the flexibility of the mattress 44, biases the pressure panel 58 outwardly (i.e. clockwise as viewed in FIGS. 2, 3 and 5), and also securely grips the sheet 14. Thus, the sheet or sheets 14 will tend to remain secured in place and can be made relatively taut.

Installing and removing the sheet or sheets 14 is facilitated because the clearance 136 is maintained by the actuator assembly 56 without having to hold the handle 118 to maintain the lever subassembly 108 in its open or release position. With the clamping device 10 in its closed or clamp position, the clamping device 10 is substantially concealed from view because the sheet 14 is clamped to the mattress liner 38 or the rail inner face 30, and the handle 118 is located under the bed floor 20 and can be spaced inboard of the rail outer face 32.

It is to be understood that while certain forms of the present invention nave been illustrated and described herein, it is not to be limited to the specific forms or arrangement of parts described and shown.

For example, alternative actuator means could be provided in lieu of the actuator assembly 56. Such alternative actuator means could comprise, for example, an inflatable, fluid-actuated bladder placed between the rail inner face 30 and the pressure panel outer face 66, with the bladder being inflatable by a suitable pump or compressor whereby the pressure panel 58 is rotated inwardly to its open or release position. The bladder could be drained or deflated to allow the pressure panel 58 to rotate to its closed or clamp position.

What is claimed and desired to be secured by Letters Patent is as follows:

1. A system for sheeting a waterbed including an elevated bed floor and a longitudinal frame rail extending upwardly from the bed floor, an upwardly-open mattress receptacle formed by said bed floor and said frame rail, a water mattress in said mattress receptacle and including a water mattress wall in proximity to said frame rail of the mattress receptacle, which comprises:

(a) a pressure panel positioned generally between said mattress wall and said frame rail;

(b) said pressure panel having a closed position in proximity to said frame rail and an open position in spaced relation from said frame rail;

(c) hinge means hingedly connecting said pressure panel and one of said frame rail and said bed floor; and (d) pressure panel actuating means for actuating said pressure panel between its open and closed positions, the actuating means adapted to move the pressure panel between an open position in which the pressure panel is pressed by the actuating means against a water mattress wall to permit the insertion of an edge portion of a sheeting material between the pressure panel and the frame rail, and a closed position in which the actuating means permits a water mattress wall to press the pressure panel against the frame rail, thereby trapping an edge of the sheeting material between the pressure panel and the longitudinal frame rail.

2. The invention of claim 1 wherein said pressure panel actuating means comprises:

(a) a lever assembly extending through the bed floor.

3. The invention of claim 2 wherein said lever assembly includes:

(a) a shaft pivotally connected to one of said frame assembly and said pressure panel;

(b) an actuator projection extending from said shaft and engaging said pressure panel with said pressure panel in its open position; and (c) a handle projection projecting from said shaft.

4. The invention of claim 3 wherein:

(a) said shaft has a first end with said actuator projection extending therefrom; and (b) said shaft has a second end with said handle projection extending therefrom.

5. The invention of claim 3 wherein said lever assembly includes:

(a) a lever mounting bracket including a bracket receiver for rotatably receiving said shaft.

6. The invention of claim 5 wherein:

(a) said lever mounting bracket includes:

(1) a base plate with first and second surfaces;

(2) a saddle clamp including an arch; and (3) fastener means for fastening said saddle clamp on said base plate to form said bracket receiver and for mounting said lever assembly on one of said frame and said pressure panel.

7. The invention of claim 3, wherein:

(a) said pressure panel includes a detent selectively receiving said actuator projection with said pressure panel in its open position.

8. The invention of claim 1, which includes:

(a) a hinge base member; and (b) said hinge including a base leaf attached to said hinge base member, a panel leaf attached to said pressure panel, and a hinge pin pivotally interconnecting said hinge leaves.

9. The invention of claim 1 wherein:

(a) said pressure panel includes sheet-gripping means.

10. The invention of claim 9, which includes:

(a) said pressure panel including an upper edge; and (b) said sheet-gripping means including a J-channel mounted on said pressure panel upper edge and a resilient, sheet-gripping strip mounted thereon.

11. A clamping device adapted to releasably clamp an edge of a sheeting material between a water mattress and an upwardly-open receptacle defined by longitudinal frame rails that extend upwardly from a bed floor, which includes:

(a) a pressure panel positionable between a water mattress wall and a frame rail, and movable between open and closed positions and including inner and outer faces and upper and lower edges;

(b) a hinge mounted on said pressure panel adjacent the lower edge thereof;

(c) a base member connected to said hinge said base member adapted to be connected to one of the frame rails or the bed floor; and (d) pressure panel actuating means for actuating said pressure panel between its open and closed positions, the actuating means adapted to move the pressure panel between an open position in which the pressure panel is pressed by the actuating means against a water mattress wall to permit the insertion of an edge portion of a sheeting material between the pressure panel and the frame rail, and a closed position in which the actuating means permits a water mattress wall to press the pressure panel against the frame rail, thereby trapping an edge of the sheeting material between the pressure panel and the longitudinal frame rail.

12. The invention of claim 11, wherein said pressure panel actuating means comprises a lever assembly including:

(a) a shaft pivotally connected to said base member;

(b) an actuator projection extending from said shaft and engaging said pressure panel with said pressure panel in its open position; and (c) a handle projection projecting from said shaft.

13. The invention of claim 12 wherein:

(a) said shaft has a first end with said actuator projection extending therefrom; and (b) said shaft has a second end with said handle projection extending therefrom.

14. The invention of claim 12 wherein said lever assembly includes:

(a) a lever mounting bracket including a bracket receiver for rotatably receiving said shaft.

15. The invention of claim 14 wherein said lever mounting bracket includes:

(a) a base plate;

(b) a saddle clamp including an arch; and (c) fastener means for fastening said saddle clamp on said base plate to form said bracket receiver.

16. The invention of claim 12 which includes:

(a) said pressure panel having a detent for selectively receiving said actuator projection with said pressure panel in its open position.

17. The invention of claim 11 wherein said hinge includes:

(a) base leaf attached to said base member;

(b) a panel leaf attached to said pressure panel; and (c) a hinge pin pivotally interconnecting said hinge leaves.

18. The invention of claim 11 wherein:

(a) said pressure panel includes sheet-gripping means.

19. The invention of claim 18, which includes:

(a) said pressure panel including an upper edge; and (b) said sheet-gripping means including a J-channel mounted on said pressure panel upper edge and a resilient, sheet-gripping strip mounted thereon.

20. In combination with a waterbed including a pedestal, a bed floor mounted on the pedestal, a frame including a pair of rails with lower edges resting on the bed floor, upper edges, inner faces and outer faces; an upwardly-open receptacle formed by the frame and the bed floor; a mattress liner positioned generally inside the receptacle against the bed floor and the side rail inner faces; a water mattress positioned generally inside the receptacle and filled with water; a sheet placed over the mattress and having a pair of opposite side edges each positioned between a respective rail inner face and said mattress, the improvement of a sheet clamping device, which comprises:

(a) a panel assembly including:

(1) a base member with a lower surface positioned on top of said bed floor, an upper surface, an inner edge, an outer edge positioned against a respective rail inner face, and a base receiver extending between said upper and lower surfaces and outwardly open at said outer edge;

(2) a pair of base-to-floor screws extending through said base member and into said bed floor on either side of said base receiver;

(3) a pressure panel including inner and outer faces, upper and lower edges and a detent open at said inner face;

(4) a butt-type hinge including a base leaf attached to said base member upper surface, a panel leaf attached to said pressure panel outer face, a hinge pin pivotally interconnecting said leaves and a pivotal axis axially aligned with said hinge pin, said pivotal axis being located in closely-spaced proximity to an intersection of said base member inner edge and said base member upper surface;

(5) a sheet-gripping subassembly including a J-channel mounted on said pressure panel upper edge and a strip of resilient material mounted on said J-channel and including longitudinally-extending ridges facing upwardly and outwardly from said J-channel;

(b) an actuator assembly including:

(1) a mounting bracket subassembly including a plate, a saddle clamp including an arch forming a bracket receiver and a pair of screws extending through said saddle clamp and said base plate and into a respective rail whereby said clamp subassembly is mounted on said rail;

(2) a bed floor receiver extending through said bed floor and aligned with said bracket receiver;

(3) a lever subassembly including a lever with a shaft having upper and lower ends, an actuator extending from said shaft upper end and including a return leg extending substantially parallel to said shaft and an extension leg interconnecting said return leg and said shaft upper end, said lever further including a handle shaft extending from said shaft lower end, and said lever subassembly further including a handle mounted on said handle shaft; and (4) said actuator assembly being movable between:

(i) a clamp position with said shaft and said actuator return leg positioned in a plane generally parallel to a plane of said rail inner face, said handle substantially parallel to said rail and under said bed floor, and said sheet-gripping subassembly impinging upon said rail with said sheet clamped therebetween; and (ii) a release position with said lever actuator return leg in said pressure panel detent, said handle extending in a direction substantially perpendicular to said plane defined by said rail inner face, and said pressure panel swung inwardly with said sheet-gripping subassembly spaced inwardly from said rail inner face.

* * * * *